US009731339B2

(12) United States Patent
Miyagi et al.

(10) Patent No.: US 9,731,339 B2
(45) Date of Patent: Aug. 15, 2017

(54) METHOD FOR PRODUCING PRESS-MOLDED ARTICLE

(71) Applicant: NIPPON STEEL & SUMITOMO METAL CORPORATION, Chiyoda-ku, Tokyo (JP)

(72) Inventors: Takashi Miyagi, Tokyo (JP); Yasuharu Tanaka, Tokyo (JP); Misao Ogawa, Tokyo (JP); Toshimitsu Aso, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 0 days.

(21) Appl. No.: 14/758,864

(22) PCT Filed: Dec. 20, 2013

(86) PCT No.: PCT/JP2013/084298
§ 371 (c)(1),
(2) Date: Jul. 1, 2015

(87) PCT Pub. No.: WO2014/106931
PCT Pub. Date: Jul. 10, 2014

(65) Prior Publication Data

US 2015/0336158 A1 Nov. 26, 2015

(30) Foreign Application Priority Data

Jan. 7, 2013 (JP) ..... 2013-000594

(51) Int. Cl.
*B21J 9/02* (2006.01)
*B21D 22/20* (2006.01)
*B21D 53/88* (2006.01)

(52) U.S. Cl.
CPC ..... *B21J 9/02* (2013.01); *B21D 22/20* (2013.01); *B21D 53/88* (2013.01)

(58) Field of Classification Search
CPC ..... B21D 22/20; B21D 22/10; B21D 22/06; B21D 22/26; B21D 5/01; B21D 5/04;
(Continued)

(56) References Cited

U.S. PATENT DOCUMENTS 5,211,047 A * 5/1993 Kaneyuki ..... B21D 53/88 72/313
7,490,503 B1 * 2/2009 Kanemitsu ..... B21D 53/18 72/348
(Continued)

FOREIGN PATENT DOCUMENTS

CN 101259510 9/2008
JP 55-106524 1/1979
(Continued)

OTHER PUBLICATIONS

Machine Translation of JP 2007190588 A.*
(Continued)

*Primary Examiner* — Moshe Wilensky
*Assistant Examiner* — Pradeep C Battula
(74) *Attorney, Agent, or Firm* — Birch, Stewart, Kolasch & Birch, LLP

(57) ABSTRACT

A method produces a press-molded article having a hat shaped cross-section with flanges at both sides, a top plate, vertical walls at both sides, and having a shape curved in the vertical direction to an inverted checkmark shape along the longitudinal direction when the molded article is viewed from a side face with the top plate section on the top side. An intermediate molded body is formed by drawing a metal stock sheet into an intermediate shape, and after preparing the outside shape of the intermediate molded body by trimming, drawing is subsequently performed to form the final shape.

9 Claims, 12 Drawing Sheets

(58) Field of Classification Search
CPC ..... B21D 25/00; B21D 25/02; B21D 25/04; B21D 24/005; B21D 24/02; B21D 24/04; B21D 24/10; B21D 53/88
See application file for complete search history.

(56) References Cited

U.S. PATENT DOCUMENTS

| | | | | |
|---|---|---|---|---|
| 8,589,132 | B2 * | 11/2013 | Miyagi | G06F 17/5018 700/98 |
| 9,211,579 | B2 * | 12/2015 | Tanaka | B21D 22/26 |
| 9,266,162 | B2 * | 2/2016 | Tanaka | B21D 22/20 |
| 2004/0244458 | A1 * | 12/2004 | Yamano | B21D 25/02 72/350 |
| 2009/0272171 | A1 * | 11/2009 | Golovashchenko | B21D 22/24 72/348 |

FOREIGN PATENT DOCUMENTS

| | | | |
|---|---|---|---|
| JP | 02-151322 | | 6/1990 |
| JP | 2006-116554 | | 5/2006 |
| JP | 2007190588 | A * | 8/2007 |
| JP | 2011-045905 | | 3/2011 |
| WO | WO 2012070623 | | 5/2012 |

OTHER PUBLICATIONS

Third Party Observation of PCT/JP2013/084298 dated May 6, 2015.
Office Action dated Feb. 22, 2016 issued in corresponding Chinese Application No. 201380069175.1 [with English Translation].

* cited by examiner

METHOD FOR PRODUCING PRESS-MOLDED ARTICLE

CROSS-REFERENCE TO RELATED APPLICATIONS

This application is a national stage application of International Application No. PCT/JP2013/084298, filed Dec. 20, 2013, which is incorporated by reference in its entirety, and which claims priority to Japanese Patent Application No. 2013-000594, filed on Jan. 7, 2013.

TECHNICAL FIELD

The present invention relates to a method for producing a press-molded article, and more specifically, relates to a method for producing a press-molded article having a hat shaped cross-section and a curved portion with a shape curved in a hill shape at a longitudinal direction internal portion when viewed from a side.

BACKGROUND ART

Frame structures of vehicle bodies (body shells) of automobiles are configured by numerous combinations of frame members obtained by press-molding metal plates (steel plates are taken as an example in the explanation that follows). For example, most frame members, such as side sills, cross members, and front side members have a hat shaped cross-section over some or all of their longitudinal length, formed from a top plate section, two vertical walls joined at either side of the top plate section, and two flange portions joined to the two respective vertical walls. These frame components are important components for securing crash safety in automobiles. Strengthening, to achieve a vehicle body weight reduction as well as increases crash safety performance, is strongly desired in such frame members.

FIG. 14 is explanatory diagrams of a front side member rear 4 that is a pressed article having portion curving along the longitudinal direction with a hat shaped cross-section. FIG. 14A is a perspective view, FIG. 14B is a plan view, FIG. 14C is a side view, and FIG. 14D is a cross-section diagram taken along Sec-A in FIG. 14C.

As illustrated in FIG. 14A to FIG. 14D, the front side member rear 4 has a hat shaped cross-section configured from a top plate section 2, two side walls 3, and two flange portions 1, and a curved portion in which a part of a longitudinal internal portion of the front side member rear 4 having a shape curving along the longitudinal as viewed from a side. Namely, the front side member rear 4 has a hat shaped cross-section and a curved portion with a shape curving in the up-down direction in a hill shape at the longitudinal internal portion when the molded article is disposed with the top plate section at the top side and viewed from a side face.

As described in Patent Document 1, steel stock sheet (a blank) is generally deep drawn to mold the front side member rear 4.

PRIOR ART DOCUMENTS

Patent Documents

Patent Document 1: Japanese Patent Application Laid-Open No. H02-151322

SUMMARY OF INVENTION

Technical Problem

However, high-strength sheet steel, referred to as high tension steel, has low extendibility and poor moldability compared to low strength sheet steel. Cracks therefore develop in the top plate section 2 and vertical wall portions 3 of the molded article when blanks formed from high tension steel are drawn. Moreover, the material expands and contracts irregularly and inflow of stock material occurs when blanks formed from high tension steel are drawn. The amount of stock material inflow during molding fluctuates due to, for example, slight differences in the amount of adhering oil. The positional precision of the molded article is therefore unstable. Although cracking can be prevented by simply bending, creases arise in the flange portion 1. Therefore bending cannot be adopted.

The molded article could conceivably be given the desired dimensions by trimming after drawing. However, a press-molded article such as the front side member rear 4 illustrated in FIG. 14A to FIG. 14D does not only have the complicated shape described above, but the flange portion 1 is also curved. This therefore also makes trimming after molding difficult. Although flat plate shaped blanks formed from high tension steel are, of course, trimmable, the material expands and contracts irregularly during the drawing process and the inflow of stock material occurs as described above. Thus, the positional precision of the edges of the molded article is unstable in cases in which trimming is omitted, and a stable flange length cannot be obtained in the molded article.

Molding the press-molded article 4 illustrated in FIG. 14A to 14D with high positional precision is therefore difficult when using high tension steel as the steel stock sheet. Sheet steel having excellent extendibility and comparatively low strength must accordingly be employed, incurring an increase in plate thickness, and meaning that demands for vehicle body weight reduction cannot be met.

Solution to Problem

Aspects of the present invention are listed below.

(1) A production method for a press-molded article, the method including producing the press-molded article, which is a final molded body, by obtaining an intermediate molded body by performing preprocessing on a blank formed from a high-strength sheet steel, and by performing main processing on the intermediate molded body, wherein the final molded body has a hat shaped cross-section configured from a top plate section, two vertical walls joined to the top plate section, and two flange portions, one joined to each of the two vertical walls, and has a curved portion curved in a hill shape at a longitudinal direction internal portion as viewed from a side, wherein the intermediate molded body has a hat shaped cross-section configured from an intermediate top plate section formed by the top plate section, two intermediate vertical walls joined to the intermediate top plate section, and two intermediate flange portions, one joined to each of the two intermediate vertical walls, and, in the intermediate molded body, a height of the two intermediate vertical walls is less than a height of the two vertical walls of the final molded body in a region for forming the curved portion, and, at two remaining regions other than the region for forming the curved portion, the height gradually decreases along the longitudinal direction, as a distance from the region for forming the curved portion increases, to substantially zero at positions furthest from the region for forming the curved portion, and the main processing includes: a first step of placing the intermediate molded body on a lower die punch, and between the lower die punch and a blank holder, and an upper die that is positioned facing the lower die punch and the blank holder; a second step of placing the blank holder so as to contact the intermediate flange portions; a third step of molding a portion of the vertical walls by molding until the intermediate molded body reaches the blank holder by moving the upper die in a direction toward where the lower die punch and the blank holder are positioned; and a fourth step of molding vertical wall portions of the intermediate molded body and the flange portions joined to the vertical walls by moving the upper die and the blank holder in a direction toward where the blank holder is positioned with respect to the intermediate molded body while maintaining a state in which the intermediate molded body is pressed and clamped against the upper die by the blank holder.

When an intermediate molded body having an intermediate shape is obtained by performing preprocessing such as drawing on steel stock sheet, and bending is simply performed on the intermediate molded body, creases are generated in the flange portions of the final molded article. In contrast thereto, in the invention according to (1), the intermediate molded body has a hat shaped cross-section configured from the intermediate top plate section, the two intermediate vertical walls, and the two intermediate flange portions, and in the intermediate molded body the height of the two intermediate vertical walls is less than the height of the vertical walls of the final molded body in the region for forming the curved portion of the final molded body, and, at the two remaining regions other than the region for forming the curved portion, the height gradually decreases along the longitudinal direction on progression away from the region for forming the curved portion to substantially zero at positions furthest from the region for forming the curved portion, and bending of the third step and drawing of the fourth step are performed in sequence on this intermediate molded body.

The present invention according to (1) thereby enables prevention of generation of cracks in curved portions and creases in flange portions, which become hard-worked portions in ordinary drawing or bending.

(2) The production method for a press molded article of (1), wherein in the first step, a pad is further employed that has a shape of the top plate section of the final molded body, and is positioned facing the lower die punch and the blank holder, and in the second step, the third step, and the fourth step, the top plate section of the intermediate molded body is pressed and clamped against the lower die punch by the pad.

The present invention according to (2) enables worsening of positional precision to be prevented, since movement of the intermediate top plate section can be suppressed in the initial stage of the third step (the consecutive bending-drawing molding of the third and fourth steps) by employing a pad to restrict the intermediate top plate section of the intermediate molded body.

(3) The production method for a press molded article of (1) or (2), wherein the lower die punch includes respective shapes of the top plate section and the two vertical walls joined to the top plate section; the blank holder has a shape including shape of the flange portions; and the upper die includes respective shapes of the top plate section, the two vertical walls joined to the top plate section, and the two flange portions respectively joined to the two vertical walls.

(4) The production method for a press molded article of any one of (2) to (3), wherein the pad includes the shape of the top plate section.

(5) The production method for a press molded article of any one of (1) to (4), wherein prior to performing the main processing on the intermediate molded body, a range that does not configure the final molded body is trimmed from the two remaining regions other than the region for forming the curved portion.

The present invention according to (5) enables non-uniform inflow of stock material, due the material contracting and expanding irregularly due to drawing or the like, to be absorbed since the shape of the intermediate molded body is adjusted by trimming.

(6) The production method for a press molded article of any one of (1) to (5), wherein the height of the intermediate vertical walls at the region for forming the curved portion is from 3% to 97% of the height of the vertical walls at the curved portion.

(7) The production method for a press molded article of any one of (1) to (6), wherein the tensile strength of the high-strength sheet steel is from 590 MPa to 1800 MPa.

(8) The production method for a press molded article of any one of (1) to (7), wherein the press-molded article is a frame member of a vehicle body of an automobile.

In the present invention according to (1) to (8), a press-molded article having a hat shaped cross-section and a shape curved at a longitudinal portion when viewed from a side can be press-molded without cracks or creases being generated, and with excellent positional precision at the edges of the molded article, even when a high-strength sheet steel having a tensile strength of from 590 MPa to 1800 MPa, referred to as high tension steel, is used as the steel stock sheet. For example, weight reduction can thereby be achieved in a frame member of a vehicle body of an automobile, such as a side sill, a cross member, or a front side member rear.

Advantageous Effects of Invention

In the production method for a press molded article according to the present invention, a press-molded article having a hat shaped cross-section and a shape curved at a longitudinal direction portion when viewed from a side can be press-molded with excellent positional precision of the edges of the molded article without generating creases or cracks, even when high tension steel having a tensile strength of 590 MPa or above, 780 MPa or above, or 980 MPa or above is used as the steel stock sheet.

BRIEF DESCRIPTION OF DRAWINGS

FIG. 14 is an explanatory diagram of a front side member rear 4 that is a pressed article having a curved portion in the longitudinal direction and having a hat shaped cross-section, in which

DESCRIPTION OF EMBODIMENTS

The present invention is explained with reference to the attached drawings.

1. Press-Molded Article Produced by the Present Invention

The shape of the press-molded article produced by the present invention is the same as the press-molded article 4 illustrated in FIG. 14A to FIG. 14D.

Figure 14A:
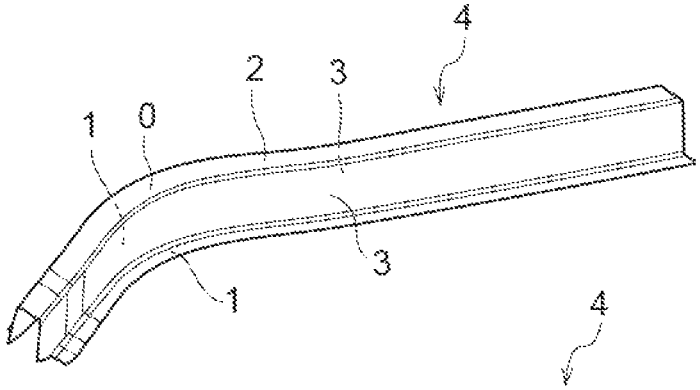
FIG. 14A is a perspective view.
Figure 14B:
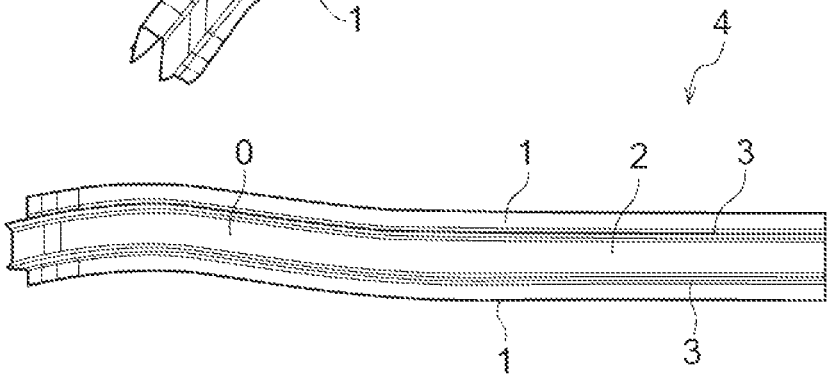
FIG. 14B is a plan view.
Figure 14C:
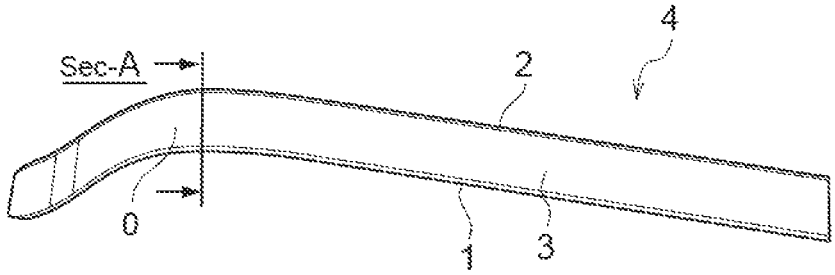
FIG. 14C is a side view.
Figure 14D:
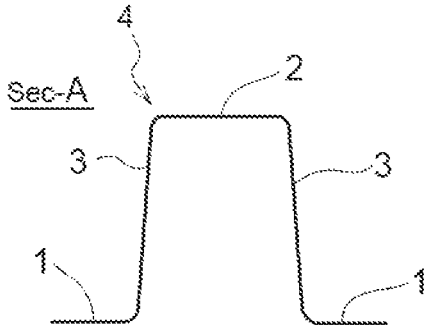
FIG. 14D is a cross-section taken along Sec-A in FIG. 14C.

The press-molded article 4 has a hat shaped cross-section configured from the top plate section 2, the two vertical walls 3, and the two flange portions 1 joined to the two respective vertical walls 3. The press-molded article 4 has a curved portion 0 shaped so as to be curved in a hill shape at a longitudinal direction internal portion when viewed from a side. As illustrated in FIG. 14B, the press-molded article 4 has a slightly curved shape when the longitudinal direction is viewed from the side of the top plate section 2, though this curve need not be present.

In the production method of the present invention, the press-molded article is the final molded body.

The press-molded article produced by the present invention (simply referred to as a "press-molded article" hereafter) is, for example, employed as a frame member of a vehicle body of an automobile, such as a side sill, a cross member, or a front side member rear.

The press-molded article is formed from high-strength sheet steel having a tensile strength of from 590 MPa, from 780 MPa, or from 980 MPa, to 1800 MPa. Although the tensile strength of sheet steel generally employed for frame members in vehicle bodies of automobiles is 440 MPa grade, an increase in the strength of component materials is desired to improve crash safety performance, and employment of high strength sheet steel of 590 MPa or above is desired. Weight reduction is desirable from the viewpoint of improving fuel efficiency, and employment of high-strength sheet steel of 780 MPa or above, and more preferably 980 MPa or above, is desirable in order to achieve a reduction in plate thickness by strengthening.

2. Production Method According to the Present Invention

As described above, press-molded articles having a complicated shape are normally drawn so as not to generate creases in production. However, cracks develop in the molded article when drawing is performed in cases in which the steel stock sheet is high tension steel having a tensile strength of 590 MPa or above that is insufficiently workable, and positional precision is lowered due to the material contracting and expanding irregularly, and due to the inflow of stock material. Moreover, many creases are generated in the flange portions when bending is performed.

Therefore, in the production method according to the present invention, a press-molded article is produced by a first process that gives an intermediate molded body through performing preprocessing on a blank formed from high-strength sheet steel, and through a second process of performing main processing on the intermediate molded body. Explanation of the first and second processes follows in sequence.

(1) First Process

Figure 1A:
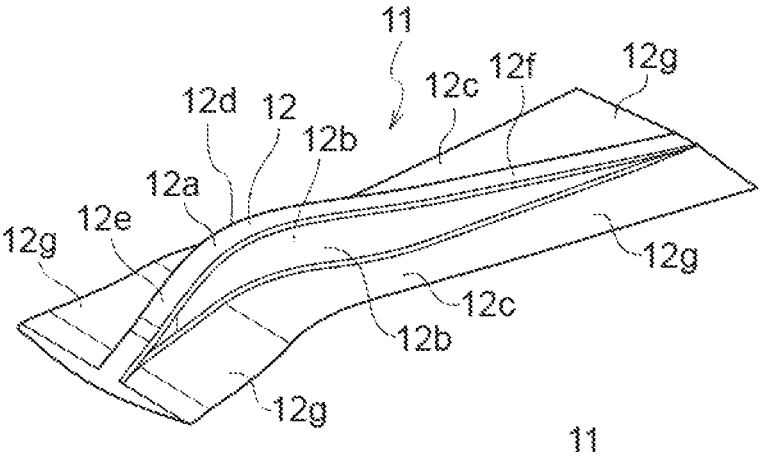
FIG. 1A to FIG. 1C are, respectively, a perspective view, a plan view, and a side view of an intermediate molded body that has been drawn as pre-molding.
Figure 1B:
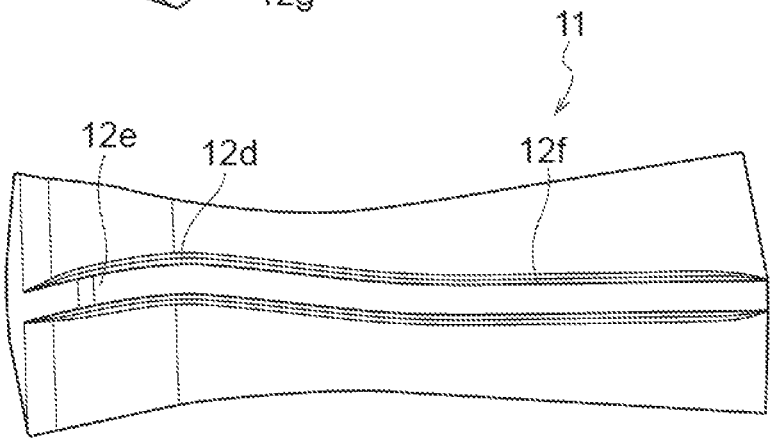
Figure 1C:
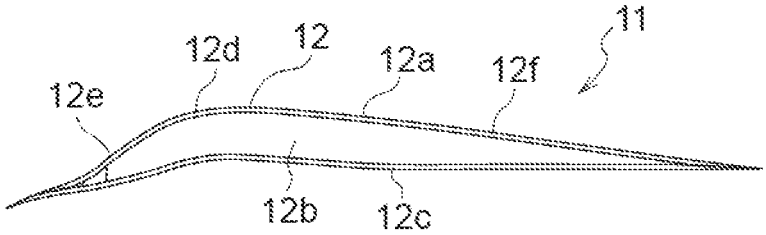
Figure 2:
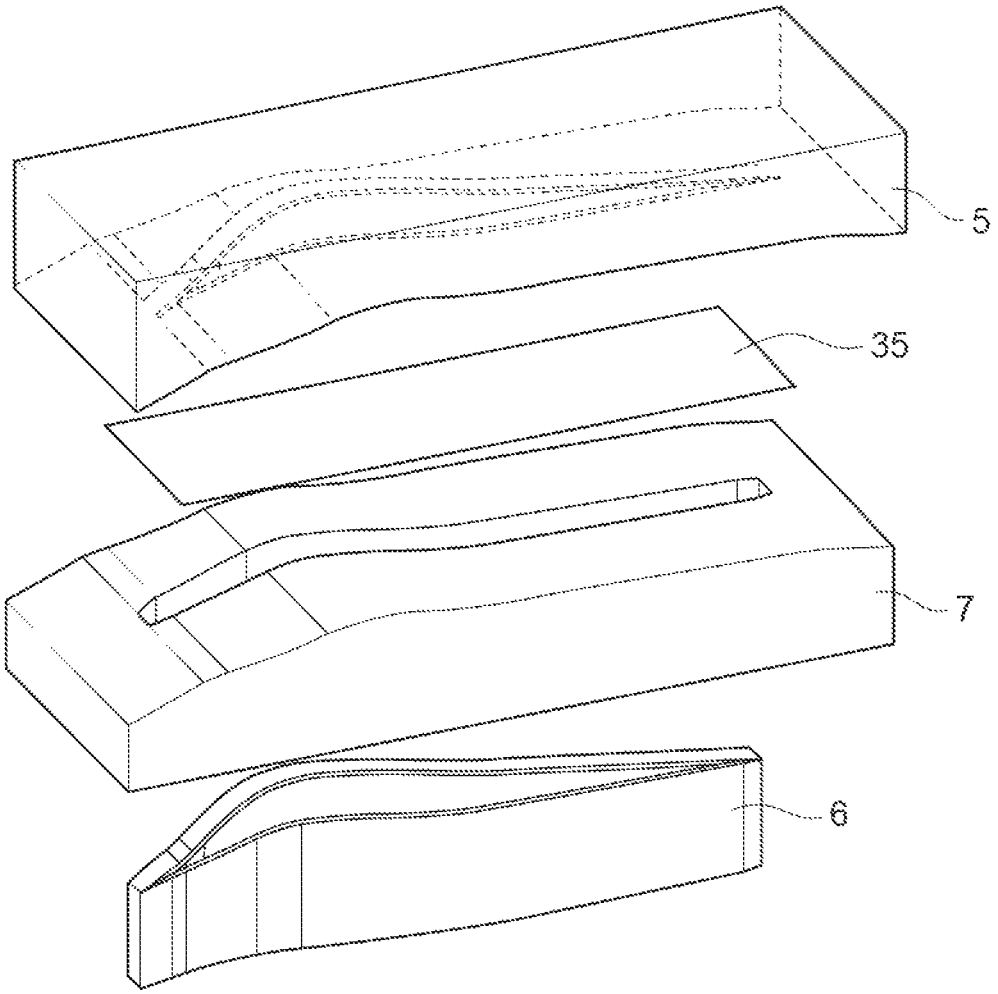
FIG. 2 is an explanatory diagram illustrating a configuration of a mold employed in a drawing process for pre-molding an intermediate molded body.
Figure 3A:
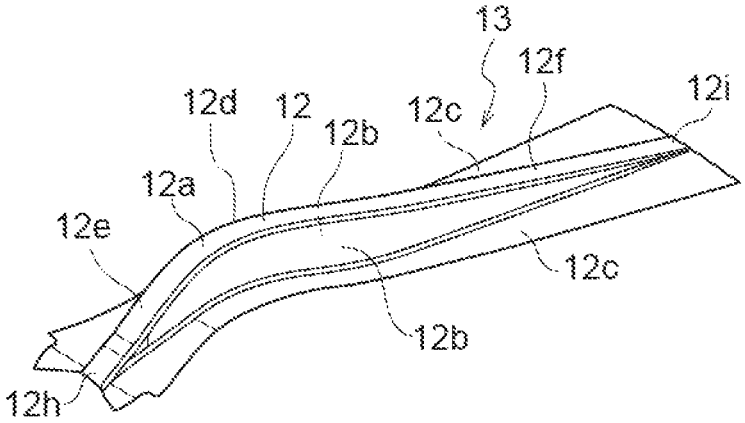
FIG. 3A to FIG. 3D are, respectively, a perspective view, a plan view, a side view, and a cross-section view taken along Sec-B, illustrating a post-trimming intermediate molded body.
Figure 3B:
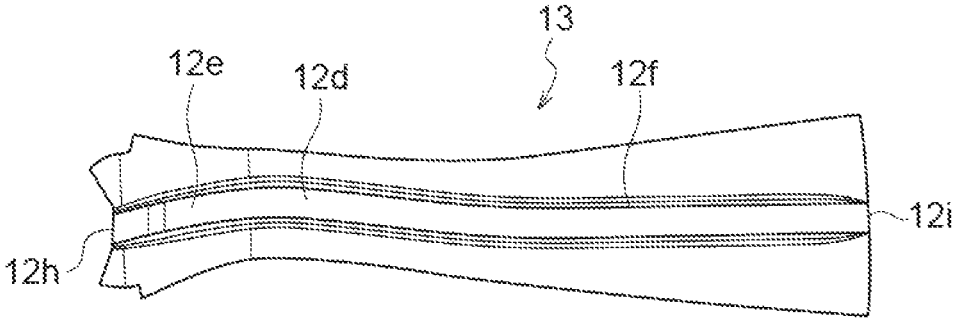
Figure 3C:
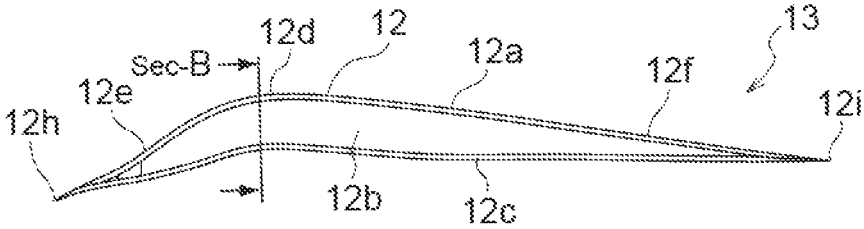
Figure 3D:
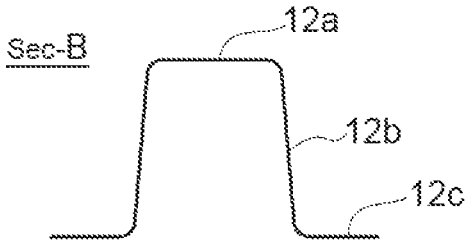
Figure 4A:
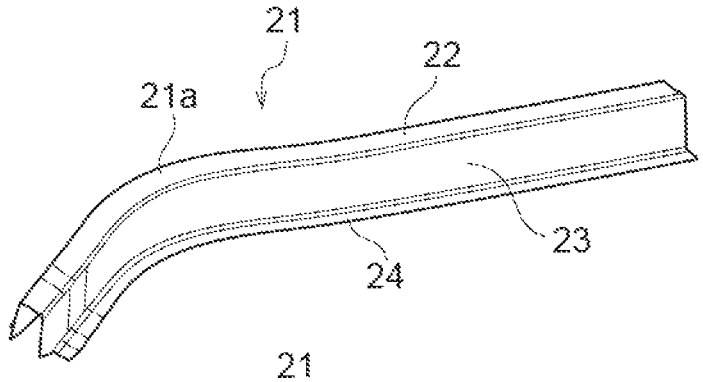
FIG. 4A to FIG. 4D are, respectively, a perspective view, a plan view, a side view, and a cross-section taken along Sec-C, illustrating a final molded body formed by consecutively performing bending and drawing in sequence.
Figure 4B:
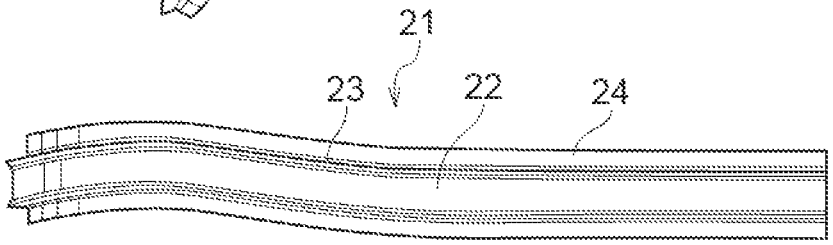
Figure 4C:
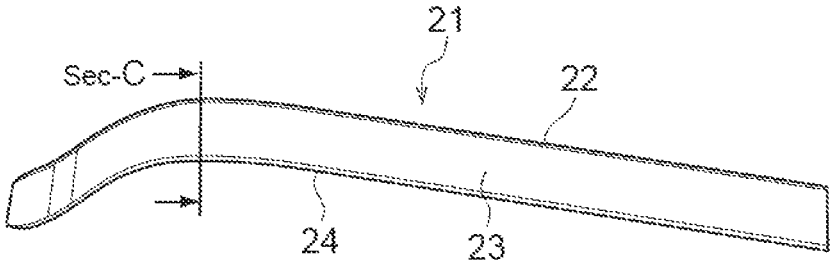
Figure 4D:
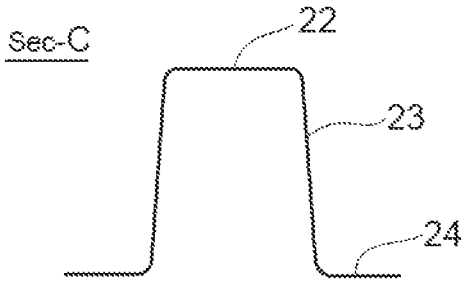

FIG. 1A to FIG. 1C are, respectively, a perspective view, a plan view, and a side view of an intermediate molded body 11 molded by drawing as pre-molding. FIG. 2 is an explanatory diagram of a configuration of a mold used in the drawing process to pre-mold the intermediate molded body 11.

As illustrated in FIG. 1A to FIG. 1C and FIG. 2, in the first process, a metal stock sheet 35 is preprocessed into the intermediate molded body 11 using the mold illustrated in FIG. 2. In FIG. 2, reference numeral 5 indicates an upper die used in preprocessing, reference numeral 6 indicates a lower die punch used in preprocessing, and reference numeral 7 indicates a blank holder used in preprocessing.

In the press-molded article 4 illustrated in FIG. 14A to FIG. 14D, the portion at the cross-section 1 (Sec-A) where the top plate section 2 is highest, namely, the curved portion 0 in the press-molded article 4, is the most difficult portion to mold. The intermediate molded body 11 is formed by drawing a hill shaped projection 12 in which the portion formed by curved portion 0 is highest and that is gently inclined toward both sides of the curved portion 0 while maintaining the shape of an outer peripheral edge portion 12*g* of the metal stock sheet 35 in a shape as close as possible to a flat sheet shape.

Namely, the intermediate molded body 11 has a hat shaped cross-section configured from an intermediate top plate section 12*a* that is formed at the top plate section 2, two intermediate vertical walls 12*b* joined to the intermediate top plate section 12*a*, and two intermediate flange portions 12*c* joined to the two respective two intermediate vertical walls 12*b*.

The height of the two intermediate vertical walls 12*b* is set such that (A) at a region 12*d* for forming the curved portion 0, the height is slightly less than the height of the vertical walls 3 of the press-molded article 4 that is the final molded body; (B) at two remaining regions 12*e*, 12*f* in the longitudinal direction other than the region 12*d* for forming the curved portion 0, the height gradually decreases on progression away from the region 12*d* for forming the curved portion 0; and (C) at positions furthest from the region for forming the curved portion 0, the height is substantially zero.

FIG. 3A to FIG. 3D illustrate a post-trimming intermediate molded body 13 that has been trimmed, and are, respectively, a perspective view, a plan view, a side view, and a cross-section taken along Sec-B.

In the first process, if necessary, trimming may be performed on the intermediate molded body 11 to eliminate effects of non-uniform inflow of stock material caused by expansion and contraction of the material generated when drawing the intermediate molded body 11, to obtain the post-trimming intermediate molded body 13.

Namely, among the two remaining regions 12*e*, 12*f*, other than the region 12*d* for forming the curved portion 0, the outer peripheral edge portion 12*g* of the intermediate molded body 11, this being a range that will not configure the press-molded article 4, is trimmed prior to performing the main processing on the intermediate molded body 11 using the second process, described below.

The trimming is performed on the outer peripheral edge portion 12*g* of the intermediate molded body 11 where projecting portions of stock material for configuring the projection 12 are not present on the intermediate molded body 11. Cutting can therefore be performed in a direction orthogonal to the press direction using a cutting method that is not, for example, a special cutting procedure such as laser cutting, using trimming that is possible in the press processing and without employing a complicated cutting method such as cam cutting, enabling an increase in production cost to be suppressed.

Trimming is performed to a width that widens on progression toward the end portions 12*h*, 12*i* of the projection 12 so as to give the shape of the press-molded article 4.

The external profile of the intermediate molded body 11 can be adjusted by performing this trimming, enabling non-uniform inflow of stock material, from irregular expansion and contraction of material caused by drawing or the like, to be absorbed.

(2) Second Process

FIG. 4A to FIG. 4D illustrate a pressed article 21 that is the final molded body that has been molded by performing bending and drawing consecutively, and are, respectively, a perspective view, a plan view, a side view, and a cross-section taken along Sec-C. Note that the molding of the second process is also referred to as "consecutive bending-drawing molding" in the following explanation.

The post-trimming intermediate molded body 13 is molded by the second process into the pressed article 21 that is the final molded body illustrated in FIG. 4A to FIG. 4D. The reference numerals 22, 23, and 24 in FIG. 4A to FIG. 4D indicate a top plate section, vertical walls, and flanges of the pressed article 21, respectively.

Figure 5:
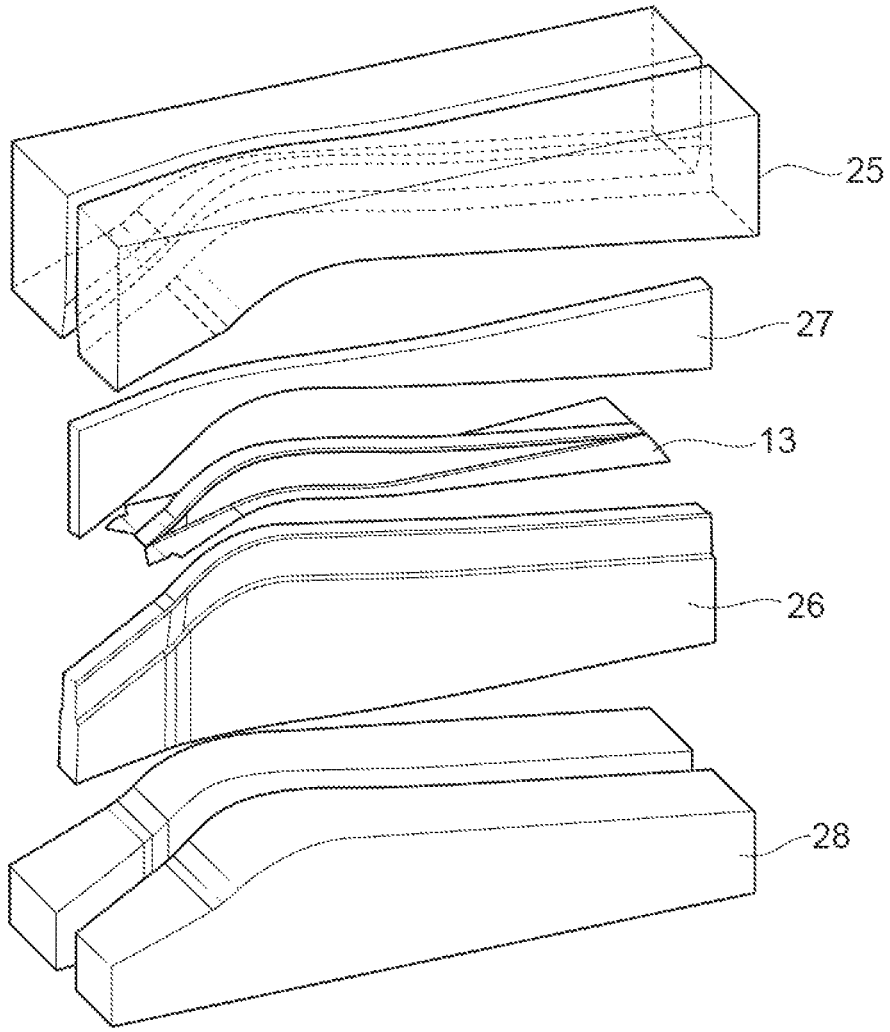
FIG. 5 is an explanatory diagram illustrating a configuration of a mold employed in consecutive bending-drawing molding of a second process.
Figure 6A:
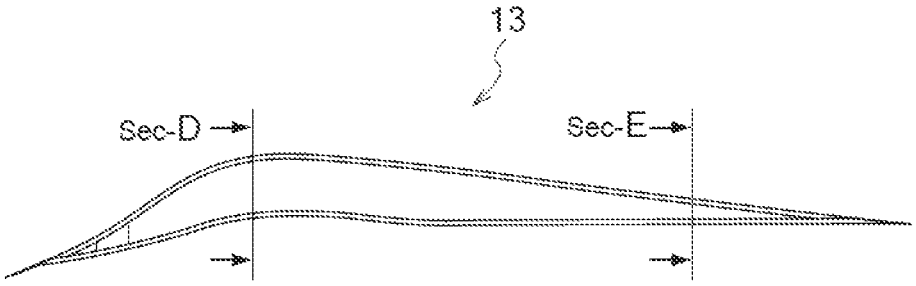
FIG. 6A is a side view of a post-trimming intermediate molded body employed in consecutive bending-drawing molding of the second process.

FIG. 5 is an explanatory diagram illustrating a configuration of a mold employed in the consecutive bending-drawing molding of the second process. FIG. 6A is a side view of the post-trimming intermediate molded body 13 employed in the consecutive bending-drawing molding of the second process. In FIG. 5, the reference numeral 25 indicates an upper die, the reference numeral 26 indicates a lower die punch, the reference numeral 27 indicates a pad, and the reference numeral 28 indicates a blank holder.

The lower die punch 26 includes the respective shapes of the top plate section 22, and the two vertical walls 23 joined to the top plate section 22. The blank holder 28 has a shape including the respective shapes of the two flange portions 24. The upper die 25 includes the respective shapes of the top plate section 22, the two vertical walls 23 joined to the top plate section 22, and the two flange portions 24 joined to the two respective vertical walls 23.

The pad 27 may also be employed if necessary. The pad 27 has the shape of the top plate section 22 of the final molded body 21. The pad 27 is placed facing the lower die punch 26 and the blank holder 28, together with the upper die 25. In a second step, a third step, and a fourth step, described below, the pad 27 presses and clamps the intermediate top plate section 12*a* formed by the top plate section 22 of the post-trimming intermediate molded body 13 against the lower die punch 26, thereby enabling movement of the intermediate top plate section 12*a* in the initial stage of the third step (the third and fourth steps of the consecutive bending-drawing molding) to be suppressed, and enabling a deterioration to be prevented in the positional precision at edges of the molded article.

Figure 6B:
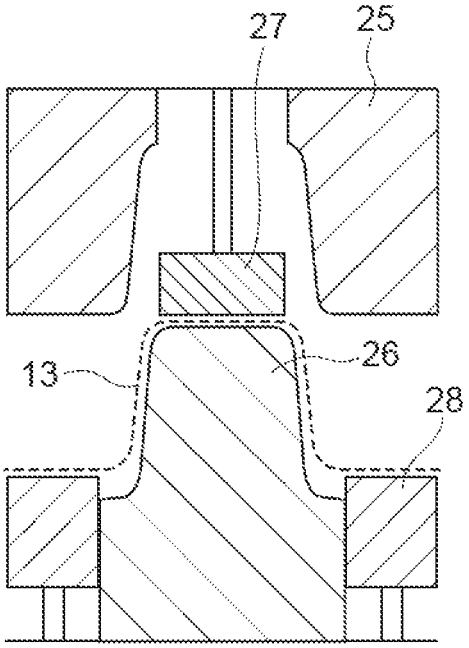
FIG. 6B is a cross-section taken along Sec-D of FIG. 6A during mold setting to perform consecutive bending-drawing molding of the second process.
Figure 6C:
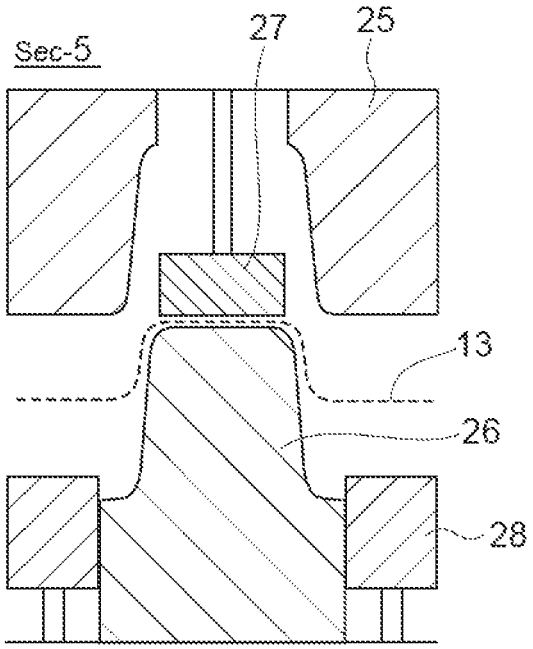
FIG. 6C is a cross-section taken along Sec-E of FIG. 6A during mold setting to perform consecutive bending-drawing molding of the second process.
Figure 7A:
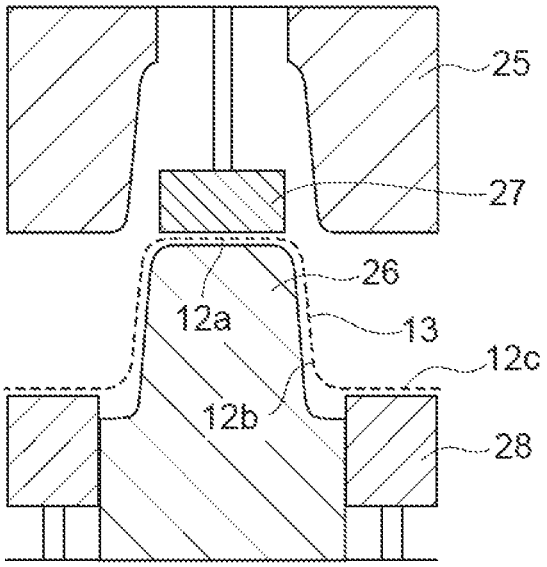
FIG. 7A is a cross-section taken along Sec-D in a bending-drawing molding process.
Figure 7B:
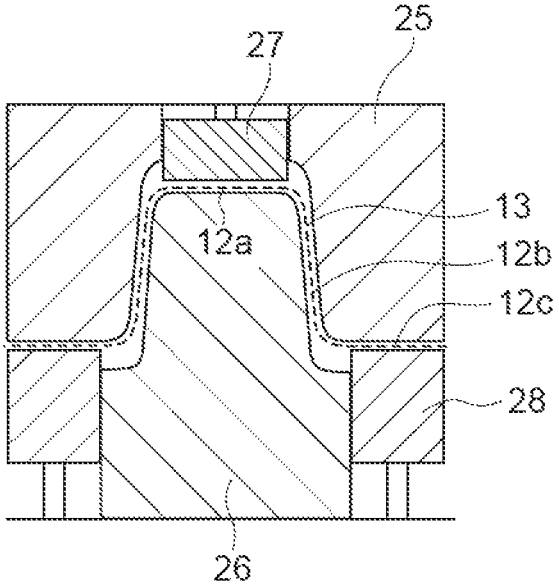
FIG. 7B is a cross-section taken along Sec-D in a bending-drawing molding process.
Figure 7C:
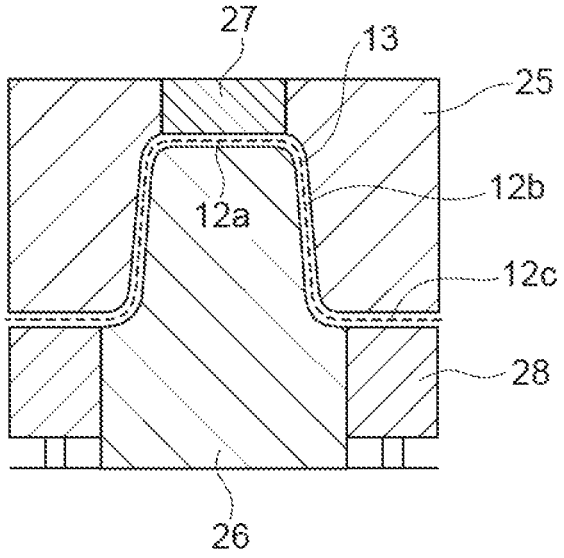
FIG. 7C is a cross-section taken along Sec-D in a bending-drawing molding process.

FIG. 6B is a cross-section taken along Sec-D in FIG. 6A during mold setting to perform the consecutive bending-drawing molding of the second process. FIG. 6C is a cross-section taken along Sec-E in FIG. 6A during mold setting to perform the consecutive bending-drawing molding of the second process. FIG. 7A is a cross-section taken along Sec-D in the consecutive bending-drawing molding process. FIG. 7B is a cross-section taken along Sec-D in the consecutive bending-drawing molding process. FIG. 7C is a cross-section taken along Sec-D in the consecutive bending-drawing molding process.

As illustrated in FIG. 6B, at the start of the consecutive bending-drawing molding of the second process, the blank holder 28 is positioned slightly higher than the surface of the lower die punch 26. First, the post-trimming intermediate molded body 13 is positioned between the lower die punch 26 and the blank holder 28, and the pad 27 and the upper die 25.

Next, as illustrated in FIG. 7A, the intermediate top plate section 12*a* of the post-trimming intermediate molded body 13 is pressed and clamped against the lower die punch 26 by the pad 27. The blank holder 28 is positioned at this time so as to contact the intermediate flange portions 12*c* of the post-trimming intermediate molded body 13. However, as illustrated in FIG. 6C that is a cross-section taken along Sec-E in FIG. 6A, contact is not needed at this time between the intermediate flange portions 12*c* of the post-trimming intermediate molded body 13 and the blank holder 28.

Note that the pad 27 does not need to be employed as long as positional precision will not be affected.

Then, as illustrated in FIG. 7B, the upper die 25 is moved in the direction toward where the lower die punch 26 and the blank holder 28 are positioned, and portions of the vertical walls 23 of the final molded body 21 are molded by molding until the post-trimming intermediate molded body 13 reaches the blank holder 28.

Then, as illustrated in FIG. 7C, the upper die 25 and the blank holder 28 are moved in the direction toward where the blank holder 28 is positioned with respect to the post-trimming intermediate molded body 13, while pressing the post-trimming intermediate molded body 13 against the upper die 25 using the blank holder 28 and maintaining a clamped state. The post-trimming intermediate molded body 13 is thereby processed so as to mold the vertical walls 23 of the final molded body 21 and the flange portions 24 joined to the vertical walls 23.

Obviously, the untrimmed intermediate molded body 11 may be employed in place of the post-trimming intermediate molded body 13 as long as the positional precision is unaffected.

In the second process, it is accordingly possible to produce the pressed article 21 without causing cracks or creases to develop by consecutively performing bending and drawing (consecutive bending-drawing molding) as a series of operations on the intermediate molded body 11 or on the post-trimming intermediate molded body 13.

In this manner, the ratio of bending to drawing in the consecutive bending-drawing molding of the second process of the present invention can be changed by setting the position of blank holder 28 higher than the final position. Namely, the ratio of drawing increases when the blank holder 28 is positioned high, and the ratio of bending increases when the position of the blank holder 28 is low.

Figure 8A:
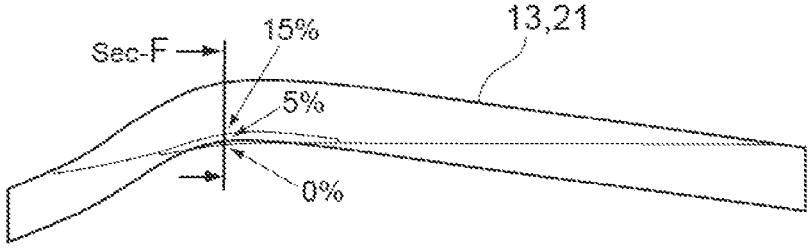
FIG. 8A is an explanatory diagram illustrating separation in a height direction between an intermediate flange portion of an intermediate molded body when consecutive bending-drawing molding of the second process is started, and a flange portion in a final molded body (namely, the difference between the height of intermediate vertical walls in the intermediate molded body and the height of vertical walls in the final molded body)
Figure 8B:
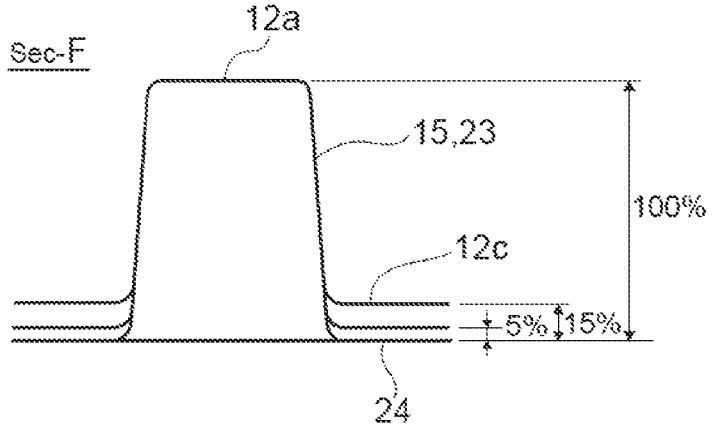
FIG. 8B is a cross-section taken along Sec-F in FIG. 8A.

FIG. 8A is an explanatory diagram illustrating separation in the height direction between the intermediate flange portions 12C of the post-trimming intermediate molded body 13 at the point in time when the consecutive bending-drawing molding starts in the second process, and the flange portions 24 of the final molded body 21 (a ratio between the height of the intermediate vertical walls in the post-trimming intermediate molded body 13, and the height of the vertical walls of the final molded by 21). FIG. 8B is a cross-section taken along Sec-F in FIG. 8A.

The height of the intermediate walls of the post-trimming intermediate molded body 13 in the region formed by a curved portion 21*a* is preferably from 3% to 97% of the height of the vertical walls of the final molded by 21. There is a high ratio of drawing at less than 3%, enabling generation of creases in the flange portions 24 to be prevented; however, the positional precision at the edges of the molded article decreases due to irregular expansion and contraction in the material and inflow of stock material occurring. At more than 97%, there is no significant difference from bending processing, and creases are readily generated in the flange portions 24 as described above. Moreover, there is also a concern regarding cracks developing in the first step in the case of insufficiently workable high tension steel. From similar viewpoints, a height of from 5% to 95% is preferable. The ratio thus represents the ratio of drawing in the consecutive bending-drawing molding of the second process, and is related to the molding ratio from the steel stock sheet to the intermediate molded body.

EXAMPLES

Figure 9A:
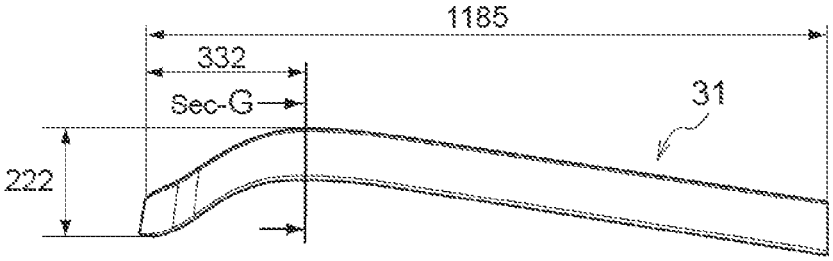
FIG. 9A and FIG. 9B are, respectively, a side view, and a cross-section taken along Sec-G of a final molded body illustrating an Example.
Figure 9B:
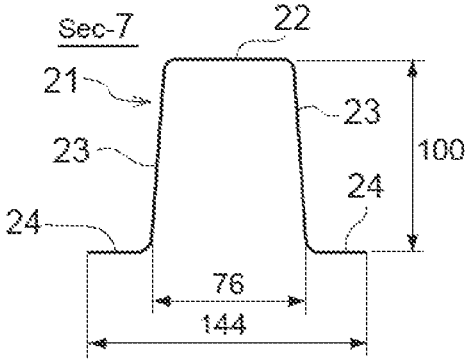

FIG. 9A and FIG. 9B are, respectively, a side view and a cross-section view taken along Sec-G of a final molded body representing an example.

In Comparative Examples 1, 2, and 3, and Present Invention Examples 1, 2, 3, and 4, molded articles 31 having the shape illustrated in FIG. 9A and FIG. 9B (wherein the units are mm) were produced, using sheet steel having a breaking strength of from 590 MPa to 980 MPa and a sheet thickness of from 1.6 mm to 2.0 mm as the steel stock sheet, and produced by: a conventional drawing method; conventional bending; a molding method according to the present invention; and a molding method according to the present invention with different conditions than that of the molding method according to the present invention.

Figure 10:
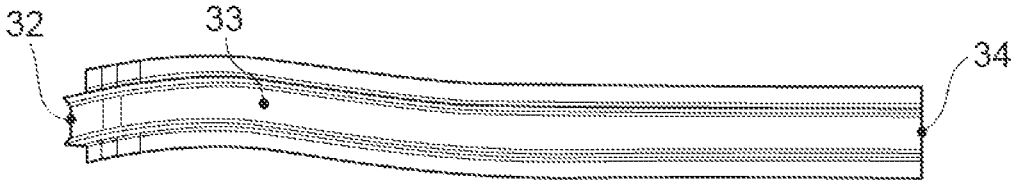
FIG. 10 is a diagram illustrating positions for displacement evaluation in the X and Y directions in the examples.

FIG. 10 is a diagram illustrating displacement evaluation positions in the X and Y directions for Comparative Examples 1 to 3 and Present Invention Examples 1 to 4, and illustrates reference points 32, 33, 34 for measuring the displacement amount in the X and Y directions.

Figure 11:
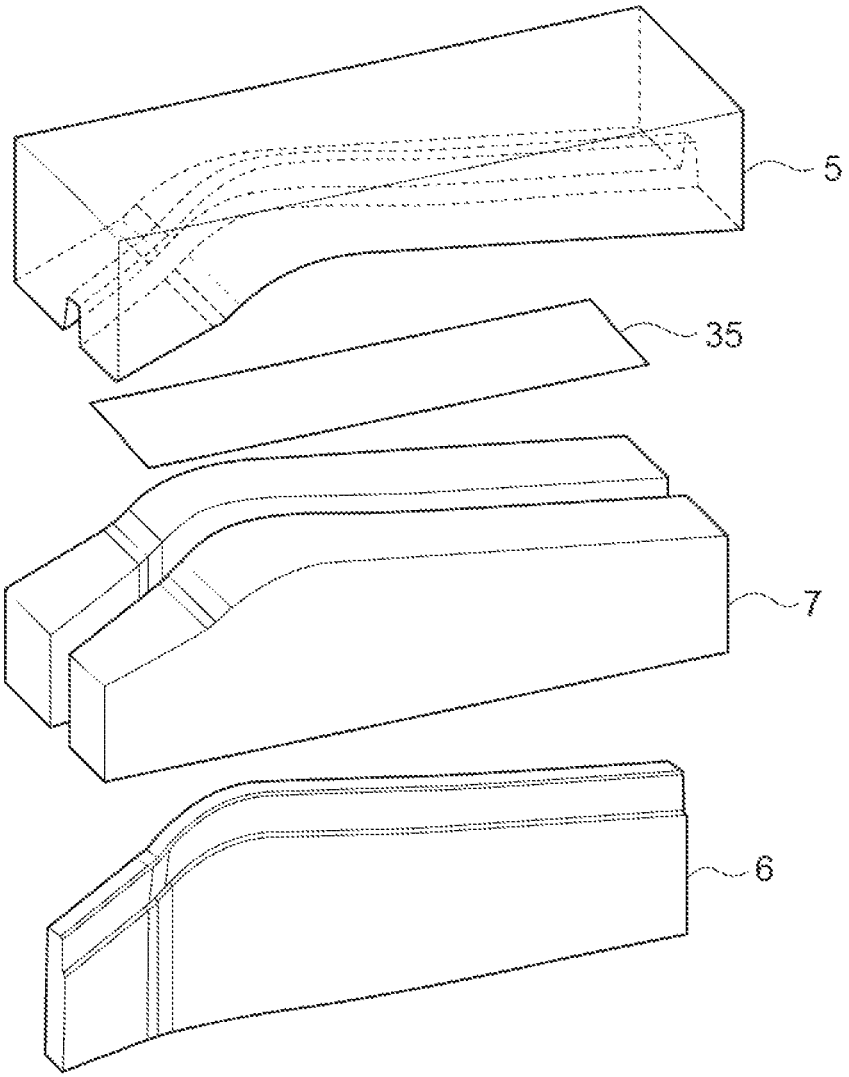
FIG. 11 is an explanatory diagram illustrating a configuration of a drawing mold employed in Example 1.
Figure 12:
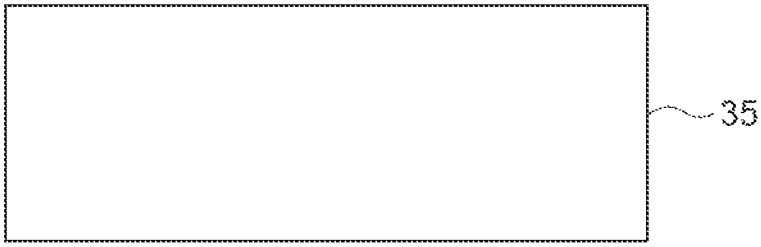
FIG. 12 is an explanatory diagram illustrating a steel stock sheet employed in Examples 1 to 7.
Figure 13:
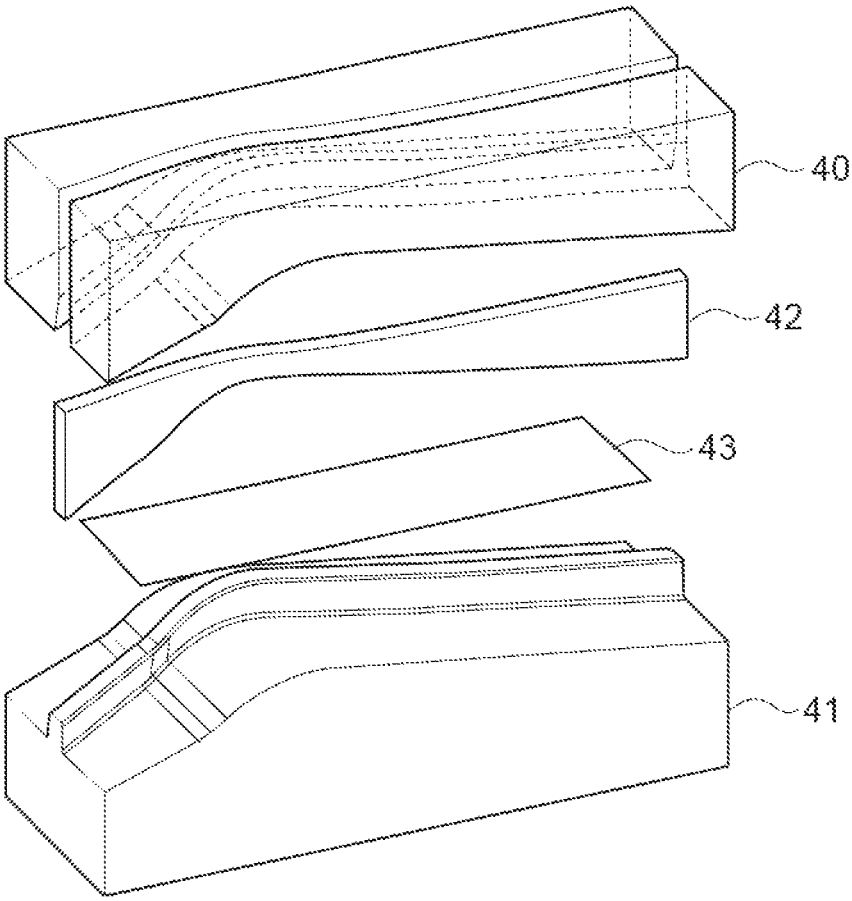
FIG. 13 is an explanatory diagram illustrating a configuration of a bending mold employed in Example 2.

FIG. 11 is an explanatory diagram illustrating a configuration of a drawing mold employed in Comparative Example 1. FIG. 12 is an explanatory diagram illustrating the steel stock sheet 35 employed in Comparative Examples 1 to 3 and Present Invention Examples 1 to 4. FIG. 13 is an explanatory diagram illustrating a configuration of a bending mold employed in Comparative Example 2. Each reference numeral in FIG. 11 is the same as the respective reference numeral in FIG. 2. In FIG. 13, the reference numeral 40 indicates an upper die, the reference numeral 41 indicates a lower die punch, the reference numeral 42 indicates a pad, and the reference numeral 43 indicates a steel stock sheet.

The results for Comparative Examples 1 to 3 and Present Invention Examples 1 to 4 are listed in Table 1.

TABLE 1

| | Steel Stock Sheet | | | | | |
|---|---|---|---|---|---|---|
| Example | Breaking Strength/ Sheet Thickness | Production Method | Wall Height Ratio* | Creases in Flange | Cracks in Molded Article | X, Y Direction Displacement Amount |
| Comparative Example 1 | 980 MPa/ 1.6 mm | drawing | Single process molding | None | Present | outside reference |
| Comparative Example 2 | 980 MPa/ 1.6 mm | bending | Single process molding | Present | None | within reference |
| Present Invention Example 1 | 980 MPa/ 1.6 mm | present invention | 5% | None | None | within reference |
| Present Invention Example 2 | 980 MPa/ 1.6 mm | present invention | 15% | None | None | within reference |
| Present Invention Example 3 | 980 MPa/ 1.6 mm | present invention | 25% | None | None | within reference |
| Present Invention Example 4 | 980 MPa/ 1.6 mm | present invention | 50% | None | None | within reference |
| Present Invention Example 5 | 980 MPa/ 1.6 mm | present invention | 75% | None | None | within reference |
| Present Invention Example 6 | 980 MPa/ 1.6 mm | present invention | 85% | None | None | within reference |
| Present Invention Example 7 | 980 MPa/ 1.6 mm | present invention | 95% | None | None | within reference |
| Comparative Example 3 | 980 MPa/ 1.6 mm | comparative example molding | 100% | Present | Cracked in first process | — |
| Present Invention Example 8 | 590 MPa/ 2.0 mm | present invention | 85% | None | None | within reference |
| Present Invention Example 9 | 780 MPa/ 1.8 mm | present invention | 85% | None | None | within reference |

*Wall height ratio: the ratio of the height of the intermediate vertical walls of the post-trimming intermediate molded body 13 to the height of the vertical walls of the final pressed article 21

Comparative Example 1 is an example in which press-molding was performed using a conventional drawing method. Cracks are generated in Comparative Example 1, the displacement amount in the X and Y directions are overly large, and positional accuracy cannot be secured.

Comparative Example 2 is an example in which press-molding was performed using a conventional bending method. In Comparative Example 2, although the displacement amount in the X and Y directions was suppressed, creases were generated in the flanges.

Present Invention Examples 1 to 7 are examples in which the height of the intermediate vertical walls of the intermediate molded body at the curved portion was set to 5%, 15%, 25%, 50%, 75%, 85%, and 95% of the height of the vertical walls of the final molded body at the curved portion. In each of Present Invention Examples 1 to 7, creases were not generated in the press-molded article, the displacement amount in the X and Y directions was suppressed, and effectiveness of the present invention was confirmed.

Comparative Example 3 is an example in which in the height of the intermediate vertical walls of the intermediate molded body at the curved portion was set to 100% of the height of the vertical walls of the final molded body at the curved portion. In Comparative Example 3, creases were generated during molding in the first process, making molding unviable in the second process.

Present Invention Example 8 is an example in which the steel stock sheet was high-strength sheet steel of 590 MPa grade, and the height of the intermediate vertical walls of the intermediate molded body at the curved portion was set to 85% of the height of the vertical walls of the final molded body at the curved portion. In Present Invention Example 8, creases were not generated in the press-molded article, the displacement amount in the X and Y directions was suppressed, and the effectiveness of the present invention was confirmed.

Present Invention Example 9 is an example in which the metal stock sheet was a sheet steel with strength of 780 MPa grade, and the height of the intermediate vertical walls of the intermediate molded body at the curved portion was set to 85% of the height of the vertical walls of the final molded body at the curved portion. In Present Invention Example 9, creases were not generated in the press-molded article, the displacement amount in the X and Y directions was suppressed, and the effectiveness of the present invention was confirmed

INDUSTRIAL APPLICABILITY

According to the present invention, a press-molded article having a hat shaped cross-section and a curved portion with a shape curved in a hill shape at a longitudinal direction internal portion when viewed from a side can be molded without cracks or creases being generated, and with high positional precision even when a high-strength sheet steel having a tensile strength of 590 MPa or above serves as the steel stock sheet.

EXPLANATION OF THE REFERENCE NUMERALS

0 curved portion
1 flange
2 top plate
3 vertical wall
4 press-molded article
5 upper die for preprocessing
6 lower die for preprocessing
7 blank holder for preprocessing
11 intermediate molded body
12 projection
12*a* intermediate top plate section
12*b* intermediate vertical wall
12*c* intermediate flange portion
12*d* region for forming curved portion
12*e* remaining intermediate molded article front end portion excluding region for forming curved portion
12*f* remaining intermediate molded article rear end portion excluding region for forming curved portion
12*g* outer peripheral edge portion of intermediate molded article, this being a range that does not configure final molded body
12*h* intermediate molded article front end portion of projection
12*i* intermediate molded article rear end portion of projection
13 post-trimming intermediate molded body
21 final molded body
21*a* curved portion
22 top plate section of final molded body
23 vertical wall of final molded body
24 flange portion of final molded body
25 upper die
26 lower die punch
27 pad
28 blank holder
31 press molded article
32 displacement evaluation reference point 1 in X, Y directions
33 displacement evaluation reference point 2 in X, Y directions
34 displacement evaluation reference point 3 in X, Y directions
35 steel stock sheet

The invention claimed is:

1. A production method for a press-molded article, the method comprising producing the press-molded article, which is a final molded body, by performing main processing on an intermediate molded body obtained by performing preprocessing on a blank formed from a high-strength sheet steel, wherein the final molded body has a hat shaped cross-section configured from a top plate section, two vertical walls joined to the top plate section along a longitudinal direction of the top plate section, and two flange portions, one joined to each of the two vertical walls, and has a curved portion curved in a hill shape at a longitudinal direction internal portion as viewed from a side, wherein the intermediate molded body has a hat shaped cross-section configured from an intermediate top plate section formed at the top plate section, two intermediate vertical walls joined to the intermediate top plate section along a longitudinal direction of the intermediate top plate section, and two intermediate flange portions, one joined to each of the two intermediate vertical walls, and, in the intermediate molded body, a height of the two intermediate vertical walls is less than a height of the two vertical walls of the final molded body in a region for forming the curved portion, and, at two remaining regions other than the region for forming the curved portion, the height gradually decreases along the longitudinal direction, as a distance from the region for forming the curved portion increases, to substantially zero at positions furthest from the region for forming the curved portion, and the main processing comprises:

a first step of placing the intermediate molded body on a lower die punch, and between the lower die punch and a blank holder, and an upper die that is positioned facing the lower die punch and the blank holder;

a second step of placing the blank holder such that the intermediate flange portions are disposed between the upper die and the blank holder;

a third step of molding a portion of the vertical walls by bending the intermediate molded body until the intermediate molded body reaches the blank holder by moving the upper die in a direction toward where the lower die punch and the blank holder are positioned; and a fourth step of drawing vertical wall portions of the intermediate molded body and the flange portions joined to the vertical walls by moving the upper die and the blank holder in a direction toward where the blank holder is positioned with respect to the intermediate molded body while maintaining a state in which the intermediate molded body is pressed and clamped against the upper die by the blank holder.

2. The production method for a press-molded article of claim 1, wherein:

in the first step, a pad is further employed that has a shape of the top plate section of the final molded body, and is positioned facing the lower die punch and the blank holder; and in the second step, the third step, and the fourth step, the top plate section of the intermediate molded body is pressed and clamped against the lower die punch by the pad.

3. The production method for a press-molded article of claim 2, wherein the pad includes the shape of the top plate section.

4. The production method for a press-molded article of claim 1, wherein:

the lower die punch includes respective shapes of the top plate section and the two vertical walls joined to the top plate section;

the blank holder has a shape including shape of the flange portions; and the upper die includes respective shapes of the top plate section, the two vertical walls joined to the top plate section, and the two flange portions respectively joined to the two vertical walls.

5. The production method for a press-molded article of claim 1, wherein, prior to performing the main processing on the intermediate molded body, a range that does not configure the final molded body is trimmed from the two remaining regions other than the region for forming the curved portion.

6. The production method for a press-molded article of claim 1, wherein the height of the intermediate vertical walls at the region for forming the curved portion is from 3% to 97% of the height of the vertical walls at the curved portion.

7. The production method for a press-molded article of claim 1, wherein a tensile strength of the high-strength sheet steel is from 590 MPa to 1800 MPa.

8. The production method for a press-molded article of claim 1, wherein the press-molded article is a frame member of a vehicle body of an automobile.

9. The production method for a press-molded article of claim 1, wherein:

in the second step, the blank holder is disposed such that the intermediate flange portions in the region for forming the curved portion contact the blank holder and the intermediate flange portions in the two remaining regions are disposed between the upper die and the blank holder; and in the third step, the portion of the vertical walls is molded by bending the two remaining regions.

* * * * *